United States Patent [19]

Nasgowitz

[11] 4,077,146

[45] Mar. 7, 1978

[54] SIMULATED NEON DISPLAY DEVICE

[75] Inventor: Donald D. Nasgowitz, Milwaukee, Wis.

[73] Assignee: Display Corporation International, Milwaukee, Wis.

[21] Appl. No.: 725,488

[22] Filed: Sep. 22, 1976

[51] Int. Cl.[2] ..... G09F 13/08

[52] U.S. Cl. ..... 40/564; 40/540; 40/616

[58] Field of Search ..... 40/132 R, 136, 126 B, 40/133 R, 133 B, 130 R

[56] References Cited

U.S. PATENT DOCUMENTS

| | | | |
|---|---|---|---|
| 1,635,225 | 7/1927 | Schadt | 40/136 |
| 1,688,196 | 10/1928 | Masson | 40/136 X |
| 2,620,580 | 12/1952 | Dwinell | 40/132 R |
| 2,756,528 | 7/1956 | Silver | 40/136 |
| 3,978,599 | 9/1976 | Berger | 40/132 R |

FOREIGN PATENT DOCUMENTS

| | | | |
|---|---|---|---|
| 915,522 | 6/1954 | Germany | 40/136 |

*Primary Examiner*—John F. Pitrelli

[57] ABSTRACT

A point-of-purchase display device has a body made up of a display member and walls interconnected to define an enclosed area. The display member is made of a generally transparent material having raised elongated transparent portions formed therein in a predetermined pattern. Opaque paint is applied to the transparent material exclusive of the raised transparent portions, the raised portions being covered by a transparent paint. A fluorescent light is located within the enclosed area and directs light through the combination of opaque and transparent paints to provide the general visual effect of a neon sign.

1 Claim, 3 Drawing Figures

SIMULATED NEON DISPLAY DEVICE

BACKGROUND OF THE INVENTION

I. Field of the Invention

The invention relates generally to point-of-purchase display devices and, more particularly, to such display devices which provide a simulated neon effect.

II. Description of the Prior Art

Internally or back lighted point-of-purchase display devices having translucent faces are well known, as are neon signs employing one or more neon tubes arranged to provide a lighted design. Relative to a lighted translucent sign, neon signs may provide a more distinctive and esthetically pleasing display, but conventional neon signs are expensive to manufacture and maintain. In addition, a neon sign is readily susceptible to damage by impact, intentional or otherwise, since neon signs are made of relatively fragile, evacuated glass tubing filled with neon. Further, neon signs cannot be readily and economically constructed to provide detailed designs consisting of extensive lettering or complex patterns.

This invention is concerned with this general area and has among its objects to provide an economical display device which can be easily manufactured, is durable and simulates a neon tube display and which can be readily constructed to provide any desired display design.

SUMMARY OF THE INVENTION

The invention provides a simulated neon display device comprising a body including a display member. The display member is made up of a combination of a generally opaque portion, or portions, and one or more raised, elongated generally transparent portions associated with the opaque portion and conforming to a predetermined pattern. The display member provides the general visual effect of a neon sign when it is illuminated by light directed against the opaque and transparent portions.

More specifically, the body includes walls connected to the display member to define an enclosed area. A light source, such as a fluorescent light, is secured within the enclosed area and is associated with the raised elongated transparent portions and the opaque portion to direct light therethrough. The display member preferably is made from a generally transparent material, such as clear plastic, having a plurality of raised elongated transparent portions formed or molded therein in a pattern conforming to a desired outline of indicia or lettering. Opaque material is secured to the transparent material, exclusive of the raised transparent portions, to define the opaque portions. Preferably, the raised elongated transparent portions are convex and are covered with a transparent colored paint.

In a preferred embodiment, the opaque material further defines a design portion of the opaque portion treated to achieve a translucent visual effect. More specifically, the transparent material of the display member has a first surface and a first opaque material is secured thereto in a design having open areas, i.e., areas free of the first opaque material. The second opposite surface of the transparent material has a second opaque material secured thereto opposite the open areas of the design to provide the design portion having the translucent visual effect. The first and second opaque materials preferably comprise different colored paints to enhance the translucent effect or attribute an appearance of depth to the design.

Where indicia such as lettering is provided, opaque material is located within and outside of the outline. This visually highlights the simulated neon tubes or raised transparent portions which form the lettering. These opaque materials are preferably different colored paints applied to the transparent material to enhance the highlighting.

Other features and advantages of the embodiments of the invention will become known by reference to the following general description, the appended claims and the drawings.

DESCRIPTION OF THE PREFERRED EMBODIMENT

Figure 1:
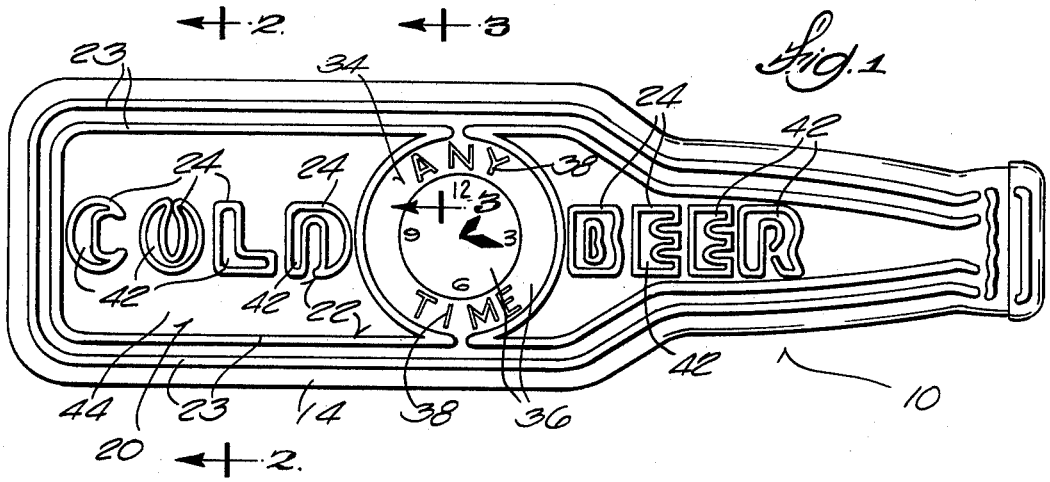
FIG. 1 is an elevational view of a display device embodying various of the features of the invention.
Figure 2:
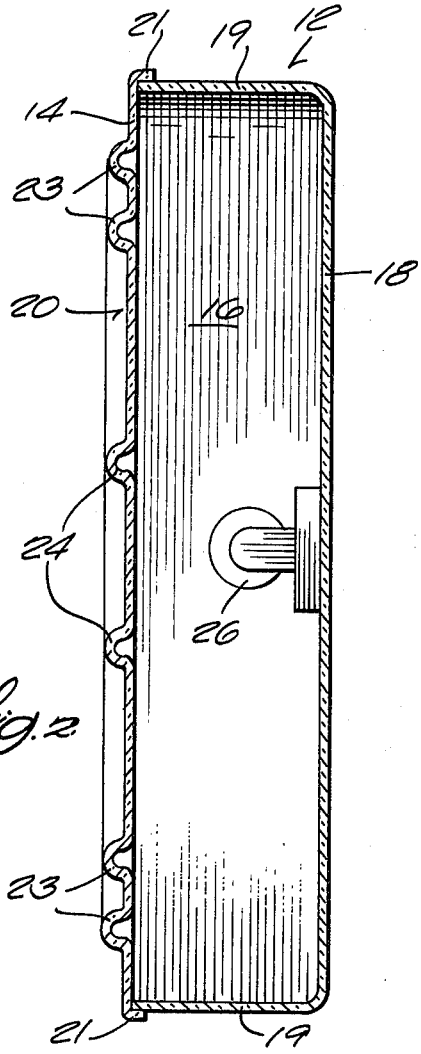
FIG. 2 is an enlarged side sectional view taken along line 2—2 shown in FIG. 1.

FIG. 1 shows a point-of-purchase display device 10 which comprises a body 12 including a basic display member 14. The display member 14 can take on any shape, such as the beer bottle shape shown, and can be contoured, cylindrical, or any other desired three dimensional cross-sectional shape. Preferably, the display member 14 is generally planar and the body 12 also includes a back wall 18 and sidewalls 19 which are connected to the display member 14 to define an enclosed, interior area 16. Sidewalls 19 extend around to provide conventional end closures (not shown) and the display member 14 preferably includes a peripheral lip 21 which overlaps and is secured to the sidewalls 19 in a conventional manner.

The display member 14 includes a generally opaque portion 20 and one or more raised, elongated generally transparent portions 22 associated with the opaque portion 20 and conforming to a predetermined pattern. The pattern of the raised, elongated transparent portions 22 can be such as to provide an outline of any desired design. In the preferred embodiment shown in FIG. 1, the raised, transparent portions 22 are in the form of a first elongated tubular pattern 23 outlining the peripheral edge of the beer bottle shape of display member 14. The transparent 22 also form an outline of indicia or second pattern 24, i.e., the lettering "COLD BEER."

A light source 26 is secured, in a conventional manner, to the back wall 18 of the body 12 and is adjacent the display member 14 so that it is associated with the raised, elongated transparent portions 22 to direct light therethrough. In the preferred construction shown, the light source 26 is a single elongated fluorescent light 26 which extends along the length of the beer bottle shaped display member 14.

Figure 3:
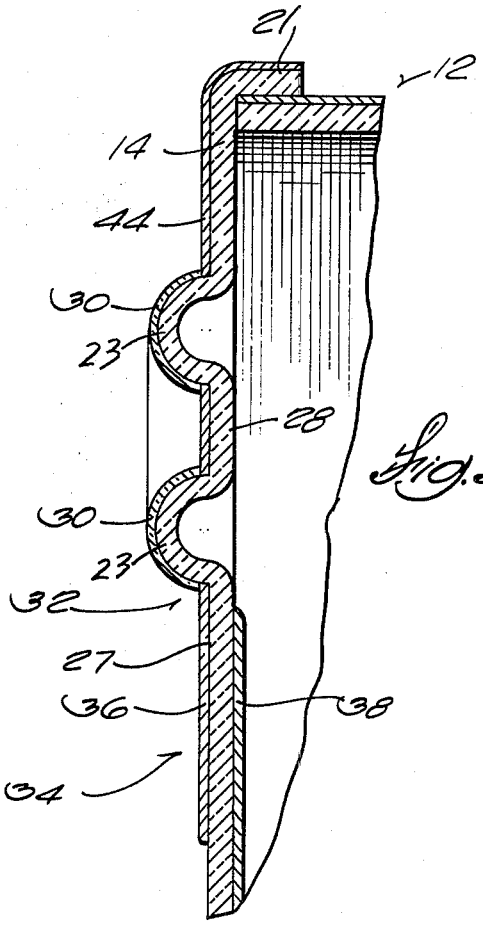
FIG. 3 is a further enlarged partial side sectional view taken along line 3—3 shown in FIG. 1.

The display member 14 is intended to provide the general visual effect of or to stimulate a neon sign when illuminated by the fluorescent light 26. To that end the display member 14 is made from a generally transparent material, preferably styrene plastic or the like and includes a first surface 27 and an opposite second surface 28. (See FIG. 3). The raised, elongated transparent portions 22 are preferably formed, or molded, within the transparent material and are convex and extend away from the light source 26. To simulate a colored neon tube, a colored transparent paint 30 is applied to the first surface 27 coincident with the raised transparent portions 22 and conforming to the first elongated tubular pattern 23. The raised transparent portions 22 conforming to the second pattern 24, the lettering "COLD BEER", can be painted in like manner but are preferably uncolored, allowing the white body of the fluorescent light 26 to be more visible therethrough.

A generally opaque material (represented generally be the numeral 32) covers the first surface 27 of the transparent material exclusive of the raised transparent portions 22 to define the opaque portion 20 of the display member. It is to be understood that if desired, the transparent colored paint 30 and the opaque material 32 can be selectively applied to both the first and second surfaces 27 and 28 to reduce the likelihood of the transparent paint or opaque material completing cracking or chipping off the basic transparent material of the display member.

The opaque material 32 can further define a logo or design portion 34 which can be made to exhibit a generally translucent visual effect. More specifically, the opaque material defining the design portion 34 comprises a first opaque material 36 on the first surface 27 in a design having open areas which, as illustrated, correspond to the lettering "ANY TIME" and a clock face. The opaque material also comprises a second opaque material 38 or backing on the second surface 28 opposite the open areas of that design to attribute an appearance of depth or a translucent visual effect to design portion 34. The first and second opaque materials are preferably different colored opaque paints.

As best shown in FIG. 1, the generally opaque material 32 also preferably comprises a third opaque material 42 on the first surface 27 and located within the outline of indicia or lettering 24, and a fourth opaque material 44 located outside of the outline 24. The third and fourth opaque materials 42 and 44 are preferably different colored opaque paints to visually highlight the outline of indicia 24.

Various methods can be utilized to manufacture the display member 14, preferably it is made in a conventional prescreened vacuum formed operation. More specifically, a distorted pattern is achieved by forming a flat sheet of styrene plastic into the beer bottle shaped display member 14 having the raised portions 22 molded therein, i.e., the first tubular pattern 23 and the outline of indicia or second lettering pattern 24. The desired patterns are then scribed or traced and the vacuum formed sheet is returned to the forming die where it is heated until it resumes its original flat shape. The tracings will now occur on the flat sheet in a distorted pattern. This distorted pattern is used to lay out the production display members and the various areas corresponding with the distorted tracings are selectively painted with the desired opaque and transparent colored paints so that, when vacuum formed, the raised transparent portions and opaque portions appear in the proper configuration.

It is to be understood that the invention provides a point-of-purchase display device having a durable simulated neon tube effect and which can be economically manufactured and readily constructed to provide any desired design.

It is also to be understood that the invention is not confined to the particular construction and arrangement of parts herein illustrated and described, but is intended to embrace all such modified forms thereof which come within the scope of the following claims.

I claim:

1. A display device comprising:

a body including a display member having a peripheral edge defining a given shape, said body including wall means connected to said peripheral edge for defining an enclosed area, said display member having a generally opaque portion, and also having raised elongated generally transparent portions forming a first pattern outlining said peripheral edge defining said given shape and a second pattern associated with said first pattern and with said opaque portion and conforming to a predetermined outline of indicia, a light source located within said enclosed area and secured to said body and associated with said raised elongated transparent portions to direct light therethrough, said display member comprising a generally transparent material including a first surface and an opposite second surface, wherein said raised elongated transparent portions are convex and are formed within said transparent material, said display member also comprising a colored transparent paint secured to said first surface coincident with said convex raised transparent portions, and a generally opaque material secured to said first surface exclusive of said convex raised transparent portions for defining said display member opaque portion, whereby said display member is adapted to provide the general visual effect of a neon sign when said convex raised elongated transparent portions are illuminated by light from said light source directed against said second surface of said transparent material, said generally opaque material further defining a design portion of said opaque portion having a translucent visual effect, said opaque material defining said design portion comprising a first opaque paint secured to said first surface and conforming to the design having open areas, and also comprising a second opaque paint secured to said second surface opposite said open area of said design, said first and second opaque paints comprising different colors so that said design portion has a translucent visual effect.

* * * * *